United States Patent [19]

Francis et al.

[11] 4,335,508

[45] Jun. 22, 1982

[54] SAFETY RAZOR HEADS

[75] Inventors: John F. Francis, Woking; Bryan R. Kirk, Tadley; John C. Terry, Reading, all of England

[73] Assignee: The Gillette Company, Boston, Mass.

[21] Appl. No.: 152,271

[22] Filed: May 22, 1980

[30] Foreign Application Priority Data

May 25, 1979 [GB] United Kingdom ..... 7918270
Mar. 26, 1980 [GB] United Kingdom ..... 8010134

[51] Int. Cl.[3] ..... B26B 21/06
[52] U.S. Cl. ..... 30/47; 30/57
[58] Field of Search ..... 30/47, 50, 57, 87

[56] References Cited

U.S. PATENT DOCUMENTS

| | | | |
|---|---|---|---|
| 1,461,168 | 7/1923 | Watt | 30/57 |
| 1,579,844 | 4/1926 | Smith | 30/57 |
| 2,392,887 | 1/1946 | Steinhauer | 30/50 |
| 2,709,850 | 7/1955 | Randol | 30/57 |
| 3,593,416 | 7/1971 | Edson | 30/50 |
| 3,740,841 | 6/1973 | Risher | 30/32 |
| 4,026,016 | 5/1977 | Nissen | 30/47 |
| 4,063,354 | 12/1977 | Oldroyd | 30/47 |
| 4,125,939 | 11/1978 | Brothers | 30/50 |
| 4,184,246 | 1/1980 | Trotta | 30/47 |
| 4,281,454 | 8/1981 | Trotta | 30/50 |

FOREIGN PATENT DOCUMENTS 1295586 11/1972 United Kingdom .

*Primary Examiner*—Nicholas P. Godici
*Attorney, Agent, or Firm*—Scott R. Foster

[57] ABSTRACT

A safety razor head, which may be a replaceable cartridge or part of a disposable razor, has leading and following tandem blades fast with a guard member and a cap member, respectively. The members are pivotally mounted for angular movement independently of each other about spaced axes parallel with the blade edges. Alternatively, the members may be interconnected by flexible bridge portions to provide for the relative angular movement of one member and blade relative to the others.

3 Claims, 7 Drawing Figures

SAFETY RAZOR HEADS

BACKGROUND OF THE INVENTION

1. Field of the Invention

This invention relates to safety razors in which provision is made for relative movement between different skin engaging elements of the razor head to take place during shaving in dependence upon the reaction forces encountered by the elements.

2. Description of the Prior Art

As used herein the term "skin-engaging elements" refers to the blade or blades of the razor, the guard which contacts the skin ahead of the blades and the cap which contacts the skin to the rear of the blade.

Relative movement between these elements is sometimes provided for the purpose of enabling the user to obtain more purchase on his beard, i.e. to increase the shaving efficiency and/or to secure a higher degree of conformance to the contours of the shaved area. Relative movement may alternatively be permitted to reduce the risk of injury, for example by allowing the blade edge to move rearwardly away from the guard against a resilient restoring force.

Examples of these two categories are found in U.S. Pat. No. 4,063,354 and British Pat. No. 1,295,586, respectively.

SUMMARY OF THE INVENTION

The present invention is specifically concerned with razors of the type including two blade members having their cutting edges parallel with each other to act in tandem upon the heard, and provide a tandem blade razor in which additional degrees of adjustability between the elements are possible.

The invention includes a tandem blade safety razor head having a leading blade fast with the guard member and a following blade fast with a cap member, and wherein the two said members are interconnected in a manner permitting angular movement of one member and its associated blade relative to the other member about an axis parallel with the cutting edges of the blades.

The cap and guard members may be pivotable, independently of each other, about spaced parallel axes parallel with the blade edges. These axes are preferably coincident or closely adjacent the respective blade edges.

Both members are preferably spring biassed towards an angular position in which the exposure of the associated blade is minimised, so that when greater pressure is exerted on each member, the exposure of the blade carried by the member is increased.

Alternatively, the guard and cap members are connected to each other by resiliently flexible bridge portions extending transversely to the blade edges.

The invention may be embodied in a disposable razor i.e. in which the shaving head and handle are integral with each other, or in a cartridge for removable mounting on a razor handle, and is described below in this latter form.

The above and other features of the invention, including various novel details of construction and combinations of parts, will now be more particularly described with reference to the accompanying drawings and pointed out in the claims. It will be understood that the particular devices embodying the invention are shown by way of illustration only and not as a limitation of the invention. The principles and features of this invention may be employed in various and numerous embodiments without departing from the scope of the invention.

BRIEF DESCRIPTION OF THE DRAWINGS

Some safety razor heads, or cartridges, in accordance with the invention will now be described in detail, by way of example, with reference to the accompanying drawings, in which.

DESCRIPTION OF THE PREFERRED EMBODIMENTS

Figure 1:
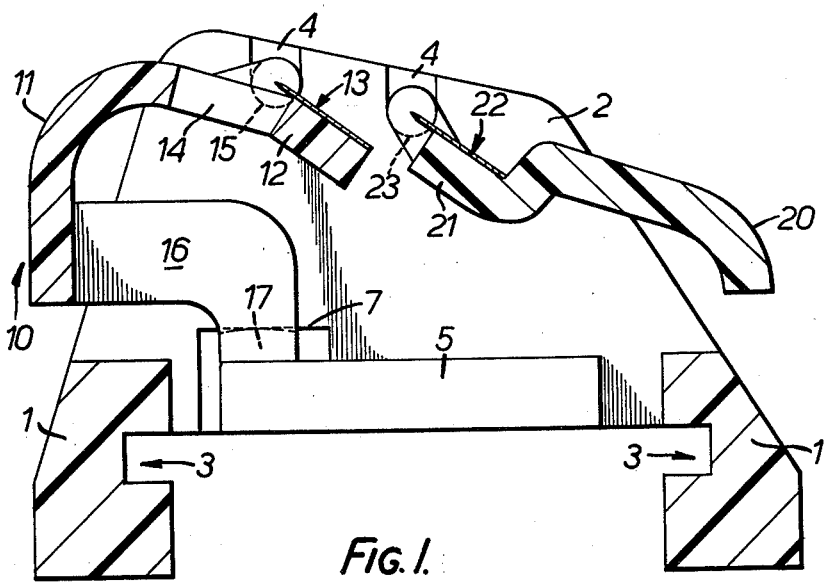
FIG. 1 is a cross-section of one form of cartridge illustrative of an embodiment of the invention.
Figure 2:
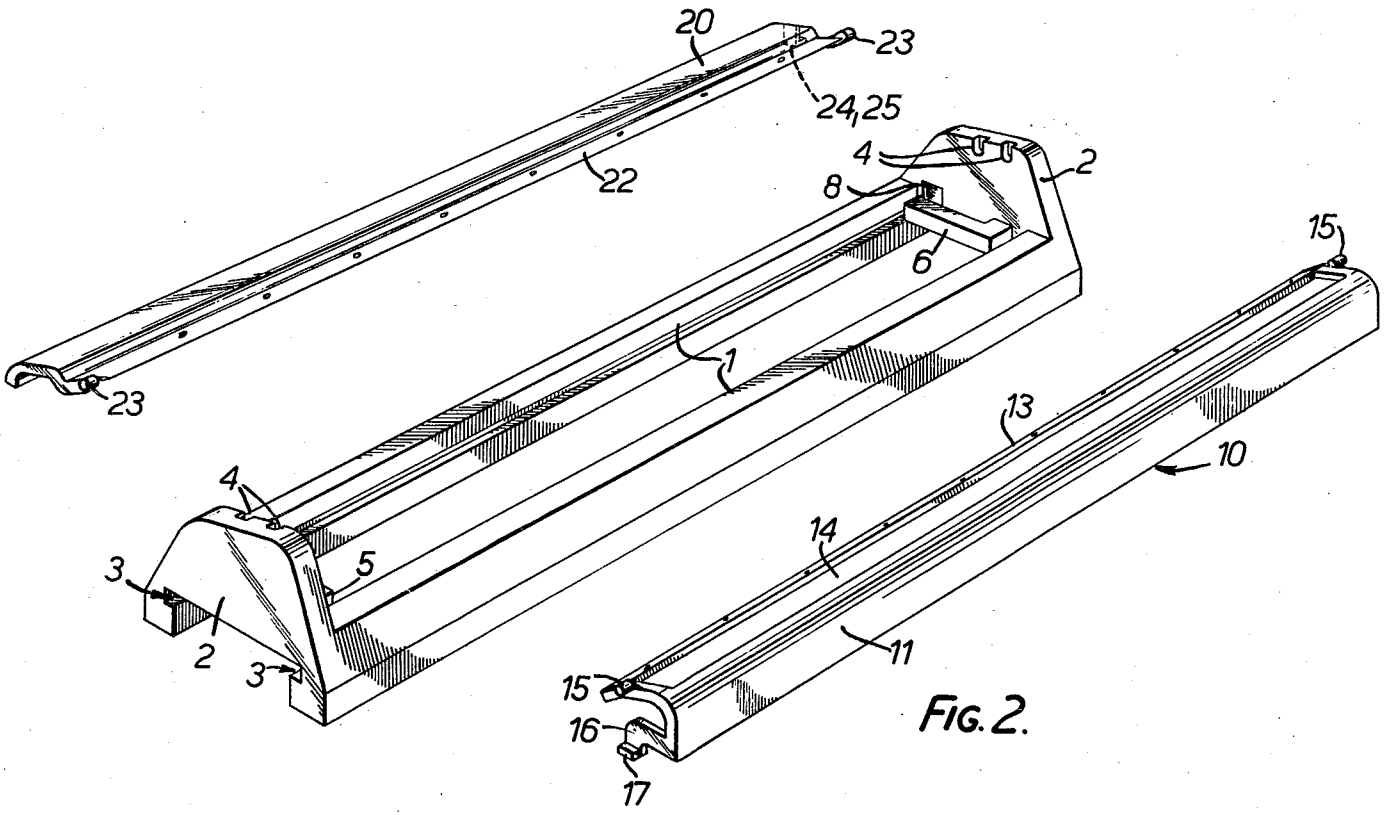
FIG. 2 is an exploded perspective view of the cartridge of FIG. 1 drawn to a smaller scale.

The cartridge shown in FIGS. 1 and 2 comprises a generally rectangular frame having opposed side walls 1 and opposed end walls 2. The side walls are formed with channels 3 for coupling the cartridge with a razor handle (not shown) having complementary mounting flanges in well known manner.

Each end wall 2 is formed on its inner face and at its upper edge with a pair of slots 4 which form mounts for the cap and guard members as described below, and with an integral cantilever spring 5 or 6, the spring 5 extending forwardly and the spring 6 rearwardly. Opposite the face end of the spring, each end wall is formed with a rectangular recess 7 or 8 whose purpose is described below.

The frame is conveniently formed as an integral moulding of synthetic plastics material for ease of manufacture.

A guard member 10 is formed as a plastics moulding or as a metal pressing having a guard portion 11 and a rearward extension forming a blade platform 12 to which a leading blade 13 is secured, e.g. by rivetting or welding. A soap slot 14, which may be continuous or interrupted, is formed beneath and forwardly of the blade edge.

At each end, the member 10 is formed with a trunnion 15 which engages in the forward slot 4 at the respective end wall 2 of the frame, so that the guard member is pivotable about an axis coincident with the cutting edge of the blade 13. The slots 4 are shaped to permit the trunnions to enter with a snap-fit.

At one end, the guard member is formed with a rearwardly extending finger 16, terminating in an outwardly extending tab 17 which is trapped between the spring 5 and the bottom of the recess 7.

A cap member 20 has a forwardly extended portion forming a blade platform 21 to which a following blade 22 is secured. The platform 21 has trunnions 23 for engagement in the rear slots 4 and at one end a finger 24 and tab 25 engaged between the spring 6 and bottom of the recess 8.

In FIG. 1, the cap and guard members are shown in their rest position, but they are pivotable against the action of the springs 5 and 6, when subjected to pressure during shaving.

The illustrated positions of the skin engaging elements are those in which the blade exposure values are at a minimum, but these values are increased by pivotal movement of the cap and guard members during shaving.

For example, if the cap member 20 is notionally fixed in its illustrated position and the guard member 10 pivots anti-clockwise (as viewed in FIG. 1) the exposure of the leading blade edge will be increased, but the exposure of the following blade edge (relative to the leading blade edge and cap member) will remain the same.

Conversely, if the guard member 10 is notionally fixed, pivoting of the cap member 20 in the clockwise direction will increase exposure of the following blade without affecting that of the leading blade.

Of course, since both members 10 and 11 are free to pivot, various combinations of blade exposures are possible, together with a high degree of conformance of facial contours.

Pivoting of the guard member anti-clockwise reduces the shaving angle of the leading blade, whilst its blade tangent angle remains constant, and clockwise pivoting of the cap member increases the shaving angle and the blade tangent angle of the trailing blade.

Figure 4:
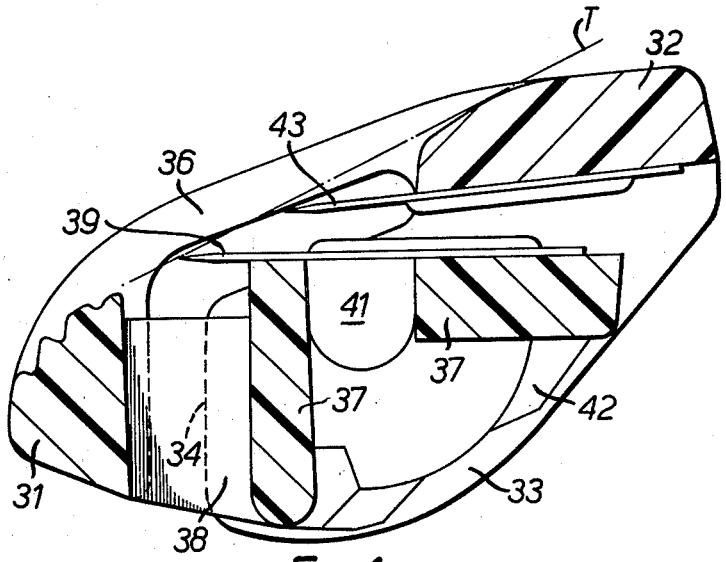
FIGS. 4 and 5 are cross-sections, drawn to a larger scale, of the cartridge of FIG. 3, with the parts in different relative positions.
Figure 3:
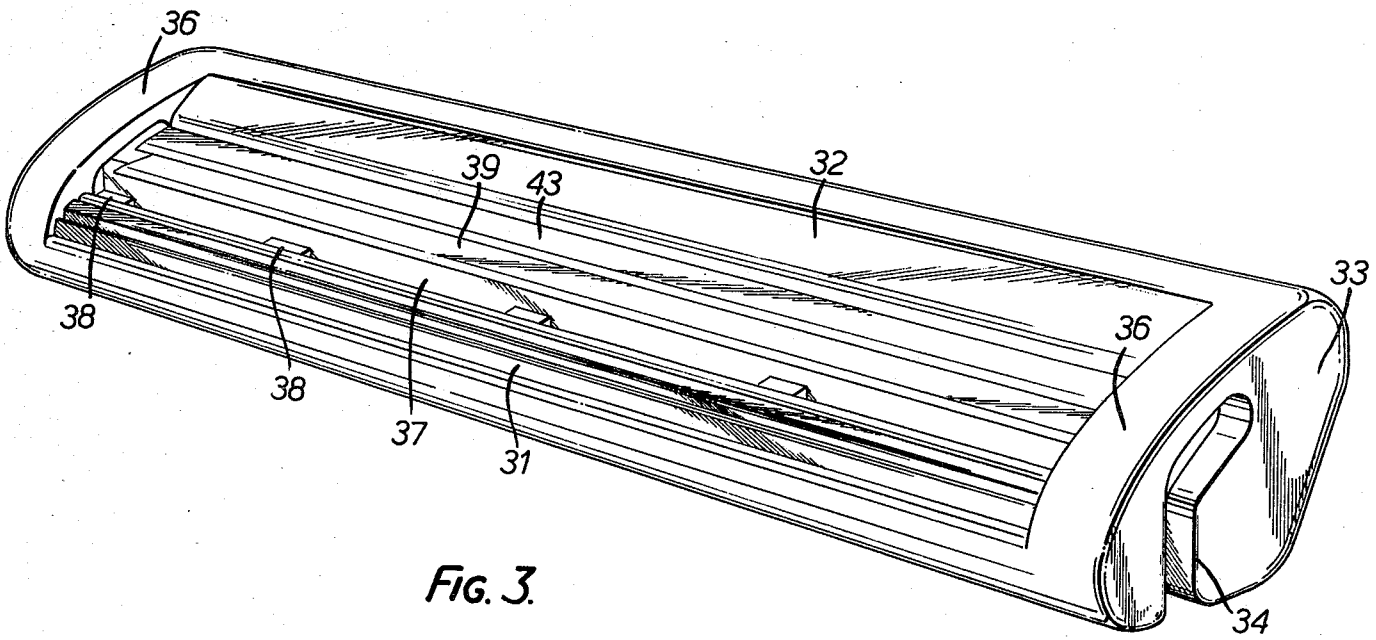
FIG. 3 is a perspective view of a second form of cartridge illustrative of an alternate embodiment of the invention.
Figure 5:
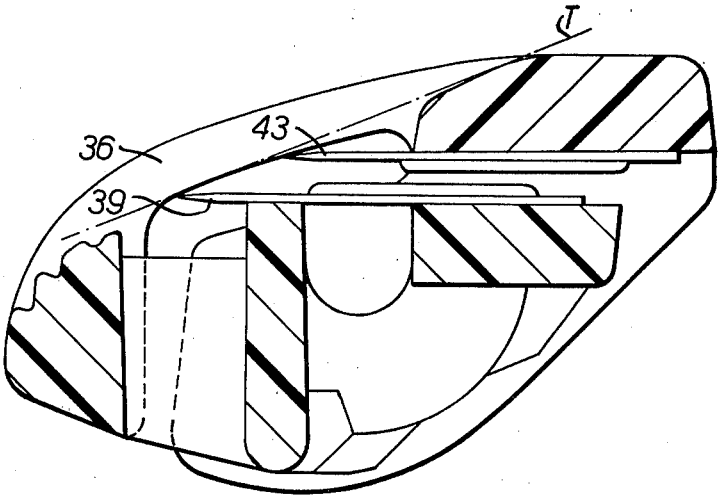

The cartridge illustrated in FIGS. 3 to 5 comprises a unitary plastics moulding formed with a guard member 31 and a cap member 32 extending between end walls 33 which are slotted at 34 to leave integral bridges 36 extending transversely to the length of the cartridge and which are sufficiently thin to permit resilient flexing of the cap member relative to the guard member.

A platform section 37 of inverted L-shape is rigidly connected to the guard member by spaced ribs 38 and carries a leading blade 39 secured as by rivetting to the section 37. The underside of the moulding is locally relieved and shaped to provide a pair of sockets 41, and at a central position with a cam formation 42 to permit the cartridge to be releasably and pivotally mounted on a razor handle of the construction described and illustrated in U.S. Pat. No. 4,083,104.

A second following blade 43 is secured to the underside of the cap member 32 and in the unstressed ("as moulded") condition of the cartridge slopes downwardly and forwardly towards the guard member. In this condition, the cutting edge of the blade 43 has a minimum exposure, preferably a negative exposure, i.e. it is set slightly below a notional plane T drawn through the cutting edge of the leading blade and tangent to the upper surface of the cap member.

In use of the cartridge reaction forces applied to the cap member cause the bridges 36 to flex up to some 6°, so as to tilt the cutting edge of the blade 43 upwardly, thereby increasing its exposure and the shaving angle. This deflection of the cap member and following blade is arranged to take place prior to pivoting of the cartridge on the handle. The deflected position of the parts is shown in FIG. 5.

In addition to permitting a degree of additional conformance to the facial contours and increasing the "purchase" of the following blade in response to pressure applied by the user, the above described construction, by providing a clear space between the blades, allows the razoe to be rinsed very efficiently, particularly from the rear of the cartridge where the gap is at its widest.

Figure 7:
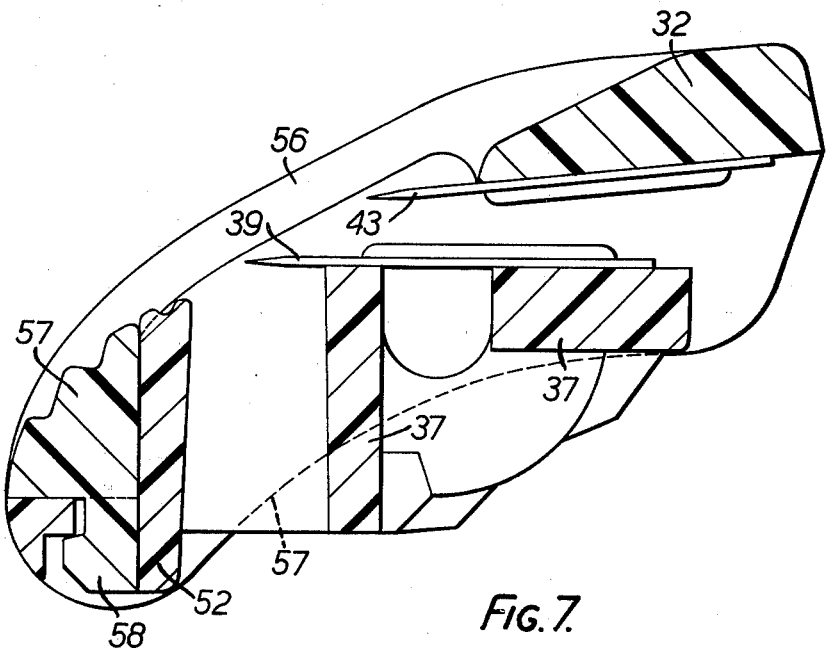
FIG. 7 is an elevational sectional view, drawn to a larger scale, of the cartridge of FIG. 6.
Figure 6:
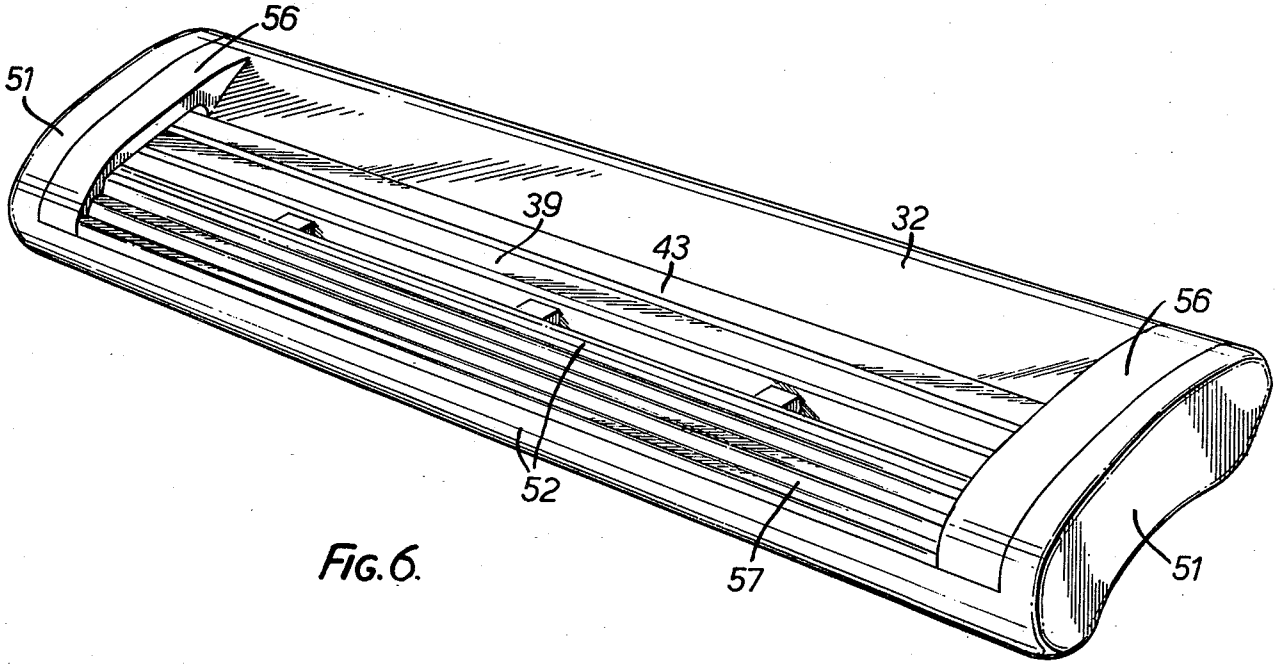
FIG. 6 is a perspective view of another form of cartridge illustrative of another embodiment of the invention.

The cartridge illustrated in FIGS. 6 and 7 is generally similar in construction and function to that of FIGS. 3 to 5, except that it is formed from two separate, and therefore simpler mouldings which are permanently secured together by snap-fitting.

More specifically, one moulding comprises the platform section 37, modified end walls 51 and a partial guard member 52 of L-shape, the lower limb of which is slotted at intervals. The second moulding comprises the cap member 32, bridges 56 and partial guard member 57 having depending barbs 58 which make snap-fitting engagement in the slots of the member 52. These may, for example, be three sets of co-operating barbs and slots, one at the centre of the cartridge and one adjacent each end.

Various modifications will be possible within the scope of the invention. For example, the underside of the cartridge can be modified to fit different razor handles, such as the widely used form having a longitudinal stick engaging in a channel formed on the cartridge, or the cartridge can form the head of a disposable razor.

We claim:

1. A tandem blade safety razor comprising a frame, a guard member, a leading blade fast with said guard member and having a cutting edge, a cap member, a following blade fast with said cap member and having a cutting edge, and pivotal mounting means mounting said respective members in said frame for independent angular movement about respective axes parallel with said cutting edges.

2. A razor head according to claim 1, wherein the said axis for each said member is coincident with or closely adjacent the said cutting edge of the respective said blade carried by that member.

3. A razor head according to claim 1, wherein the said members are each spring biassed towards an angular position in which exposure of the associated blade is minimized.

* * * * *